US005974995A

United States Patent [19]

Sato

[11] Patent Number: 5,974,995

[45] Date of Patent: Nov. 2, 1999

[54] VERTICALLY FULLY ROTATING HOOK WITH NEEDLE GUIDING SURFACE

[75] Inventor: Taisuke Sato, Osaka, Japan

[73] Assignee: Hirose Manufacturing Co., Ltd., Osaka, Japan

[21] Appl. No.: 09/119,027

[22] Filed: Jul. 20, 1998

Related U.S. Application Data

[62] Division of application No. 08/954,126, Oct. 20, 1997, Pat. No. 5,873,316.

[30] Foreign Application Priority Data

Oct. 18, 1996 [JP] Japan ..... 8-276670

[51] Int. Cl.[6] ..... D05B 55/06; D05B 57/26

[52] U.S. Cl. ..... 112/181; 112/227

[58] Field of Search ..... 112/181, 227, 112/228, 201, 231, 222

[56] References Cited

U.S. PATENT DOCUMENTS

| | | | |
|---|---|---|---|
| 2,990,794 | 7/1961 | Ketterer . | |
| 3,120,204 | 2/1964 | Ketterer . | |
| 3,533,368 | 10/1970 | Finster | 112/227 |
| 4,094,261 | 6/1978 | Ketterer et al. | 112/228 |
| 4,757,774 | 7/1988 | Junemann | 112/181 |
| 4,858,543 | 8/1989 | Badillo | 112/231 |
| 4,884,520 | 12/1989 | Shimizu . | |
| 5,109,783 | 5/1992 | Shimizu . | |
| 5,168,826 | 12/1992 | Hirose | 112/181 |
| 5,189,972 | 3/1993 | Mitsui et al. | 112/227 |

FOREIGN PATENT DOCUMENTS

| | | |
|---|---|---|
| 0 507 558 A1 | 10/1992 | European Pat. Off. . |
| 7-275548 | 10/1995 | Japan . |
| 099989 | 11/1977 | Taiwan . |
| 166274 | 8/1991 | Taiwan . |

*Primary Examiner*—Ismael Izaguirre
*Attorney, Agent, or Firm*—Wenderoth, Lind & Ponack, L.L.P.

[57] ABSTRACT

A wall of an inner loop taker includes a guiding surface, a first vertical surface which extends continuously to an inward end of the guiding surface in a radial direction of the inner loop taker and is parallel to an axial line of a needle, and a second vertical surface which is formed on the inward side of the first vertical surface in the radial direction of the inner loop taker but closer to the axial line of the needle than the first vertical surface and which is parallel to the axial line of the needle. A first angle θ between a straight line which links the inward end and an outward end of the second vertical surface in the radial direction of the inner loop taker and the axial line is smaller than a second angle between a needle tip guiding surface of the needle and the axial line, while a first length of the first vertical surface is equal to or smaller than a distance along the axial line between a bottom end portion of an inner peripheral surface of an eye of the needle and a needle tip of the needle.

6 Claims, 7 Drawing Sheets

VERTICALLY FULLY ROTATING HOOK WITH NEEDLE GUIDING SURFACE

This is a divisional application of Ser. No. 08/954,126, filed Oct. 20, 1997 now U.S. Pat. No. 5,873,316.

BACKGROUND OF THE INVENTION

1. Field of the Invention

The present invention relates to a vertically fully rotating hook of a sewing machine, and more particularly, to a vertically fully rotating hook which is preferably used in a sewing machine for zigzag sewing and a sewing machine for embroidery sewing.

2. Description of the Related Art

FIG. 1 is an expanded cross sectional view showing a needle location hole 109 and a portion around the same of an inner loop taker 100 according to a conventional technique. A needle thread 101 passes through a thread hole 104 which is formed in the vicinity of a tip portion 108 of a needle 103 which moves up and down reciprocally. When the needle thread 101 is supplied by the needle 103 immediately in front of a blade tip 102, the blade tip 102 catches the needle thread 101 and forms a needle thread loop, so that the needle thread loop is meshed with a bobbin thread not shown and a stitch is formed.

During displacement of the needle 103 downwardly, since cloth which is penetrated by the needle is moved by means of a feeding operation of the sewing machine, the needle 103 may be slightly warped in the direction in which the cloth is moved and contact a flange 105 of the inner loop taker 100. To prevent the contact from breaking the needle 103, a slanted surface 107 is formed in the vicinity of a top portion of the flange 105 to face the needle location hole 109 in the conventional technique.

In the conventional technique described above, the effect of preventing damage to the needle 103 is insufficient. Although there is not a big problem with an ordinary sewing machine in which the direction of feeding a cloth which is sewn is constant, in a zigzag sewing machine or an embroidery sewing machine, the needle 103 collides with the slanted surface 107 when a cloth is fed continuously or even during double fabric sewing of a thick cloth which is fed intermittently. When this occurs, the needle 103 is subjected to great impact, and the great impact breaks the needle 103 or damages the tip portion 108 of the needle 103.

Further, in the conventional technique described above, when the needle 103 is warped while in the needle location hole 109, the needle thread 101 is led out as it is held between a wall 106 and the needle 103. Since the needle thread 101 is formed by twisting a plurality of single threads, contact of the needle thread 101 and the wall 106 damages the single threads, whereby the thread is cut or tangled in the form of a ball.

SUMMARY OF THE INVENTION

An object of the invention is to provide for a vertically fully rotating hook which solves the problems with the conventional technique described above, prevents damage to a needle or a tip portion of the needle and avoids cutting of a thread or tangling of the thread into a ball due to a damaged needle.

The invention provides a vertically fully rotating hook comprising:

a guiding surface inclined in a direction away from an axial line of a needle with a distance outwardly in a radial direction of an inner loop taker, a first vertical surface extending to an inward end of the guiding surface in the radial direction of the inner loop taker, the first vertical surface being parallel to the axial line of the needle; and a second vertical surface formed on an inward side of the first vertical surface in the radial direction of the inner loop taker and closer to the axial line of the needle than the first vertical surface, the second vertical surface being parallel to the axial line of the needle, the guiding surface, and the first and second vertical surfaces being formed in an outward flange of the inner loop taker so as to face a needle location hole into which the needle is inserted, wherein an angle between a straight line linking the inward end of the guiding surface in the radial direction of the inner loop taker and an outward end of the second vertical surface in the radial direction of the inner loop taker, and the axial line of the needle is set as a smaller angle than that between a needle tip guiding surface of the needle and the axial line of the needle, and a length of the first vertical surface is set to be equal to or smaller than a distance along the axial line of the needle between a bottom end portion of an inner peripheral surface of an eye of the needle and a needle tip of the needle.

According to the invention, since in the outward flange of the inner loop taker, the guiding surface which is inclined in the direction away from the axial line of the needle with a distance outwardly in the radial direction of the inner loop taker, the first vertical surface extending to the inward end of the guiding surface in the radial direction of the inner loop taker and is parallel to the axial line of the needle, and the second vertical surface which is formed on the inward side of the first vertical surface in the radial direction of the inner loop taker but closer to the axial line of the needle than the first vertical surface and which is parallel to the axial line of the needle are formed at the needle location hole in which the needle is inserted, when the needle is displaced downwardly (or inwardly) the needle tip of the needle does not collide with the outward flange of the inner loop taker.

Further, since the angle between the straight line linking the inward end of the guiding surface in the radial direction of the inner loop taker and the outward end of the second vertical surface in the radial direction of the inner loop taker and the axial line of the needle is set as a smaller angle than the angle between the needle tip guiding surface of the needle and the axial line of the needle and since the length of the first vertical surface is set to be equal to or smaller than the distance along the axial line of the needle between the bottom end portion of the inner peripheral surface of the eye of the needle and the needle tip of the needle, the needle tip of the needle does not collide with the outward end of the second vertical surface in the radial direction of the inner loop taker nor a horizontal surface which extends continuously from the outward end to the inward end of the first vertical surface in the radial direction of the inner loop taker and which is vertical to the axial line of the needle.

According to the invention, since the guiding surface which is formed in the outward flange of the inner loop taker is inclined in the direction away from the axial line of the needle with a distance outwardly in the radial direction of the inner loop taker, the needle tip guiding surface of the needle does not collide with the outward flange, so that damage to the needle is prevented. In addition, since the first vertical surface is formed to extend to the inward end of the guiding surface in the radial direction of the inner loop taker and parallel to the axial line of the needle at a position facing the needle location hole in which the needle is inserted, and since the second vertical surface is formed on the inward side of the first vertical surface in the radial direction of the inner loop taker but closer to the axial line of the needle than the first vertical surface to be parallel to the axial line of the needle at the needle location hole, when the needle is displaced downwardly, the needle tip of the needle does not collide with the outward flange of the inner loop taker. Further, since the angle between the straight line linking the inward end of the guiding surface in the radial direction of the inner loop taker and the outward end of the second vertical surface in the radial direction of the inner loop taker and the axial line of the needle is set smaller than the angle between the needle tip guiding surface of the needle and the axial line of the needle and since the length of the first vertical surface is set to be equal to or smaller than the distance along the axial line of the needle between the bottom end portion of the inner peripheral surface of the eye of the needle and the needle tip of the needle, the needle tip of the needle does not collide with the outward end of the second vertical surface in the radial direction of the inner loop taker nor the horizontal surface which extends continuously from the outward end to the inward end of the first vertical surface in the radial direction of the inner loop taker and which is vertical to the axial line of the needle, so that the needle thread is not held between the needle and the first vertical surface, damage to the needle thread is prevented and hence cutting of the thread is avoided.

Further, the invention provides a vertically fully rotating hook a vertically fully rotating hook comprising:

a guiding surface inclined in a direction away from an axial line of a needle with a distance outwardly in a radial direction of an inner loop taker, a first vertical surface extending to an inward end of the guiding surface in the radial direction of the inner loop taker, the first vertical surface being parallel to the axial line of the needle; and a second vertical surface formed on an inward side of the first vertical surface in the radial direction of the inner loop taker and closer to the axial line of the needle than the first vertical surface, the second vertical surface being parallel to the axial line of the needle, the guiding surface, and the first and second vertical surfaces being formed in an outward flange of the inner loop taker so as to face a needle location hole into which the needle is inserted, wherein an angle between a straight line linking the inward end of the guiding surface in the radial direction of the inner loop taker and an outward end of the second vertical surface in the radial direction of the inner loop taker, and the axial line of the needle is set as a smaller angle than that between a needle tip guiding surface of the needle and the axial line of the needle, and a length of the first vertical surface is set to be equal to or smaller than a distance along the axial line of the needle from a central position which is on the axial line of the needle between top and bottom end portions of an inner peripheral surface of an eye of the needle, to a needle tip of the needle.

According to the invention, since in the outward flange of the inner loop taker, the guiding surface which is inclined in the direction away from the axial line of the needle with a distance outwardly in the radial direction of the inner loop taker, the first vertical surface which extends to the inward end of the guiding surface in the radial direction of the inner loop taker and is parallel to the axial line of the needle, and the second vertical surface which is formed on the inward side of the first vertical surface in the radial direction of the inner loop taker but closer to the axial line of the needle than the first vertical surface and which is parallel to the axial line of the needle are formed at the needle location hole in which the needle is inserted, when the needle is displaced downwardly, the needle tip of the needle does not collide with the outward flange of the inner loop taker.

Further, since the angle between the straight line linking the inward end of the guiding surface in the radial direction of the inner loop taker and the outward end of the second vertical surface in the radial direction of the inner loop taker and the axial line of the needle is set as a smaller angle than the angle between the needle tip guiding surface of the needle and the axial line of the needle and since the length of the first vertical surface is set to be equal to or smaller than the distance along the axial line of the needle from the central position which is on the axial line of the needle between the top and bottom end portions of an inner peripheral surface of the eye of the needle, to the needle tip of the needle, the needle tip of the needle does not collide with the outward end of the second vertical surface in the radial direction of the inner loop taker nor a horizontal surface which extends continuously from the outward end to the inward end of the first vertical surface in the radial direction of the inner loop taker and which is vertical to the axial line of the needle.

Further, the invention provides a vertically fully rotating hook comprising:

a stepped wall including a plurality of vertical surfaces parallel to an axial line of the needle and closer to the axial line of the needle with a distance inwardly in a radial direction of an inner loop taker, the stepped wall being formed in an outward flange of the inner loop taker so as to face a needle location hole in which the needle is inserted.

wherein angles between straight lines linking outward ends of the vertical surfaces of the wall in the radial direction of the inner loop taker to each other and the axial line of the needle are set smaller than an angle between a needle tip guiding surface of the needle and the axial line of the needle, and a length of each one of the vertical surfaces is set to be equal to or smaller than a distance along the axial line of the needle between a bottom end portion of an inner peripheral surface of an eye of the needle and a needle tip of the needle.

According to the invention, since in the outward flange of the inner loop taker, the stepped wall including the plurality of vertical surfaces is formed at the needle location hole in which the needle is inserted, the plurality of vertical surfaces being parallel to the axial line of the needle and closer to the axial line of the needle with a distance inwardly in the radial direction of the inner loop taker, the angles between straight lines linking outward ends of the vertical surfaces of the wall in the radial direction of the inner loop taker to each other and the axial line of the needle are set smaller than the angle between the needle tip guiding surface of the needle and the axial line of the needle, and the length of each one of the vertical surfaces is set to be equal to or smaller than the distance along the axial line of the needle between the bottom end portion of the inner peripheral surface of the eye of the needle and the needle tip of the needle, the needle tip of the needle does not collide with the outward end of each vertical surface in the radial direction of the inner loop taker nor a horizontal surface which extends continuously from each outward end to the inward end of each vertical surface in the radial direction of the inner loop taker and which is vertical to the axial line of the needle. Further, large warping of a needle toward an open end of an inner loop taker from a blade tip is prevented, thereby improving the sewing performance.

Still further, the invention provides a vertically fully rotating hook comprising:

a stepped wall including a plurality of vertical surfaces parallel to an axial line of the needle and closer to the axial line of the needle with a distance inwardly in a radial direction of an inner loop taker, the stepped wall being formed in an outward flange of the inner loop taker so as to face a needle location hole in which the needle is inserted, wherein angles between straight lines linking outward ends of the vertical surfaces of the wall in the radial direction of the inner loop taker to each other and the axial line of the needle are set smaller than an angle between a needle tip guiding surface of the needle and the axial line of the needle, and a length of each one of the vertical surfaces is set to be equal to or smaller than a distance along the axial line of the needle from a central position, which is on the axial line of the needle between top and bottom end portions of an inner peripheral surface of an eye of the needle, to a needle tip of the needle.

According to the invention, since in the outward flange of the inner loop taker, the stepped wall including the plurality of vertical surfaces is formed at the needle location hole in which the needle is inserted, the plurality of vertical surfaces being parallel to the axial line of the needle and closer to the axial line of the needle with a distance inwardly in the radial direction of the inner loop taker, the angles between straight lines linking outward ends of the vertical surfaces of the wall in the radial direction of the inner loop taker to each other and the axial line of the needle are set smaller than the angle between the needle tip guiding surface of the needle and the axial line of the needle, and the length of each one of the vertical surfaces is set to be equal to or smaller than the distance along the axial line of the needle from the central position on the axial line of the needle between the top and bottom end portions of the inner peripheral surface of the eye of the needle to the needle tip of the needle, the needle tip of the needle does not collide with the outward end of each vertical surface in the radial direction of the inner loop taker nor a horizontal surface which extends continuously from each outward end to the inward end of each vertical surface in the radial direction of the inner loop taker and which is vertical to the axial line of the needle. Further, large warping of a needle toward an open end of an inner loop taker from a blade tip is prevented, thereby improving the sewing performance.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
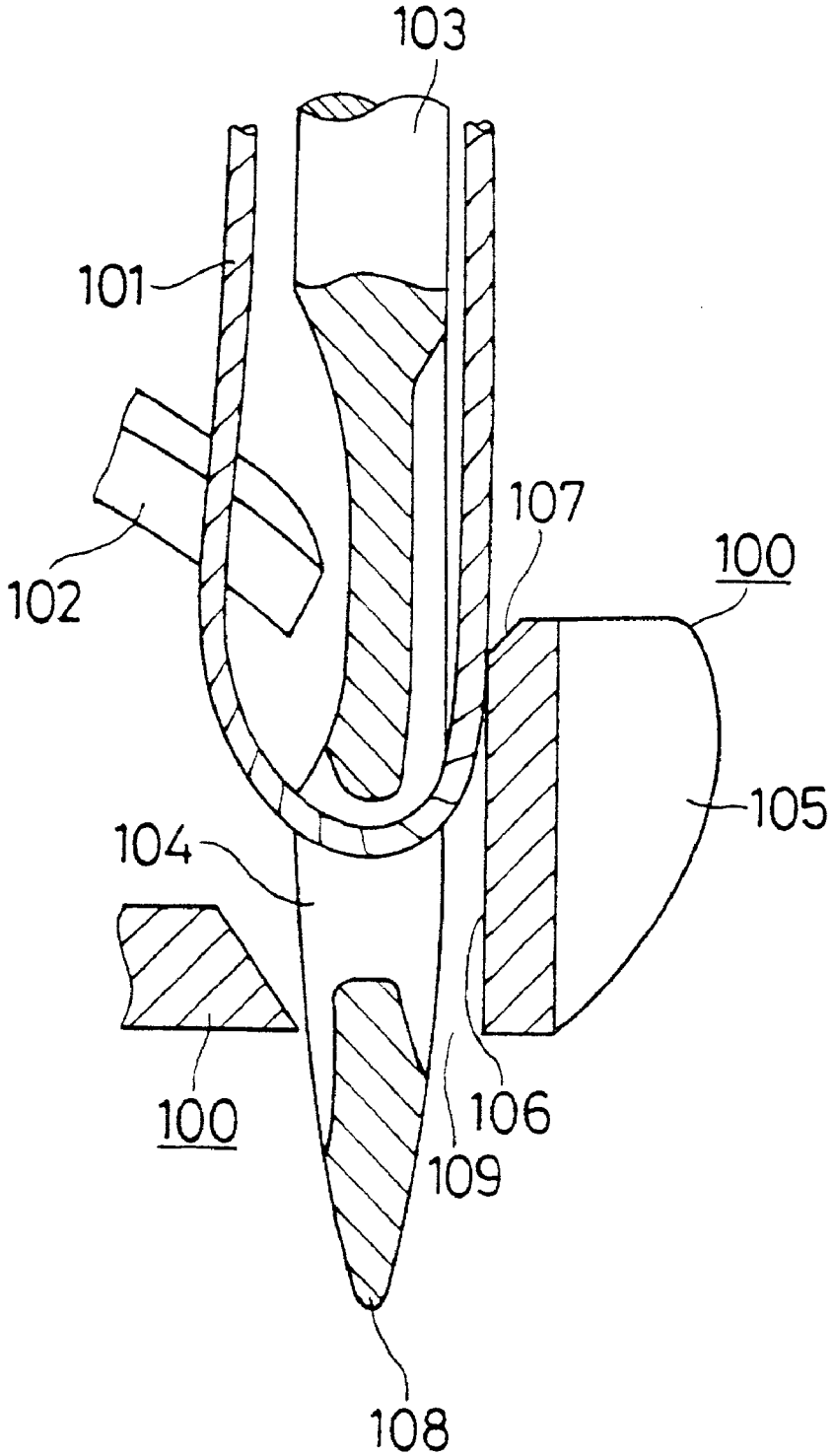
FIG. 1 PRIOR ART
FIG. 1 is an expanded cross sectional view showing a needle location hole and a portion around the same of an inner loop taker according to a conventional technique.

Now referring to the drawings, preferred embodiments of the invention are described below.

Figure 2:
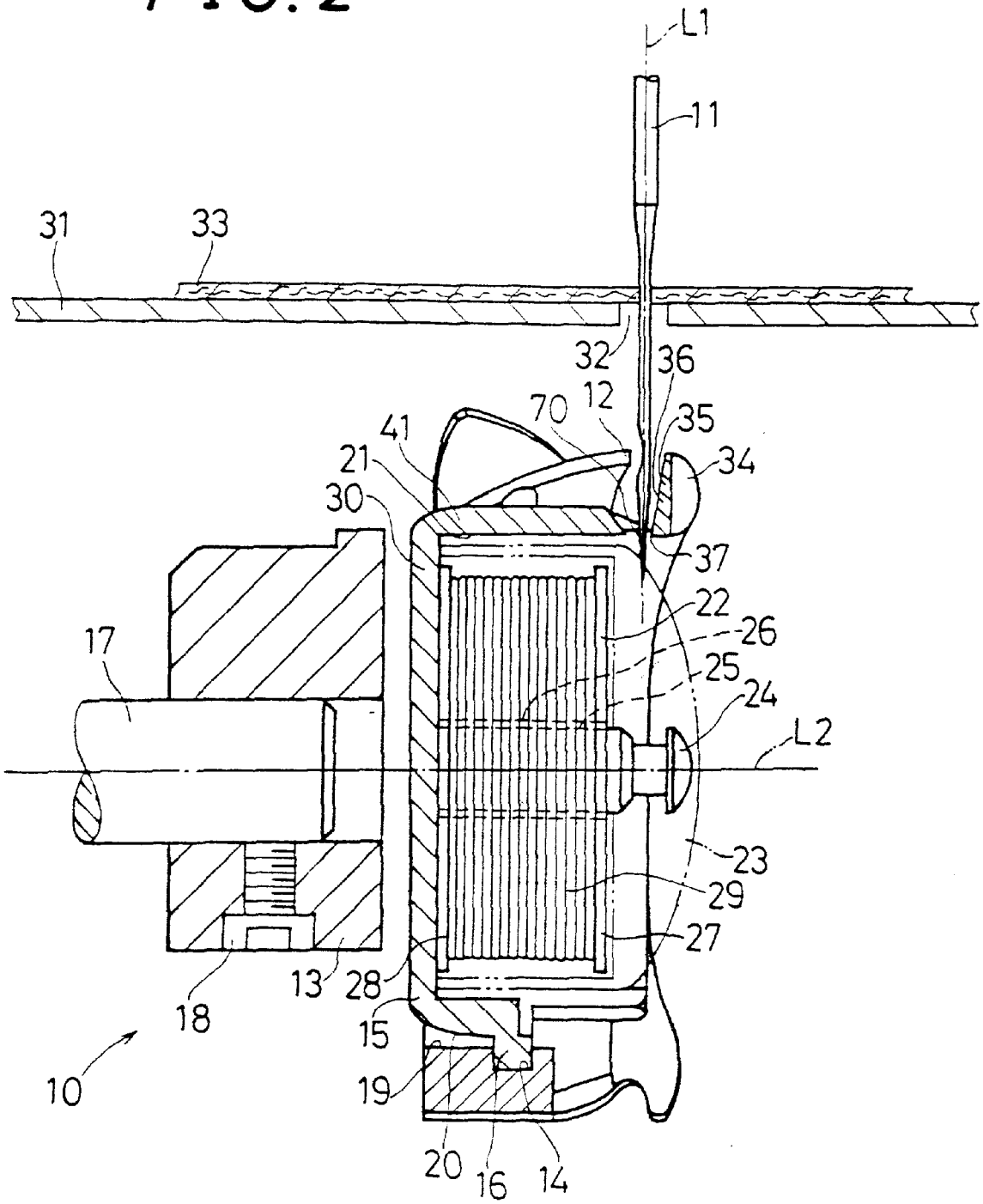
FIG. 2 is a cross sectional view of a vertically fully rotating hook according to a preferred embodiment of the invention.
Figure 3:
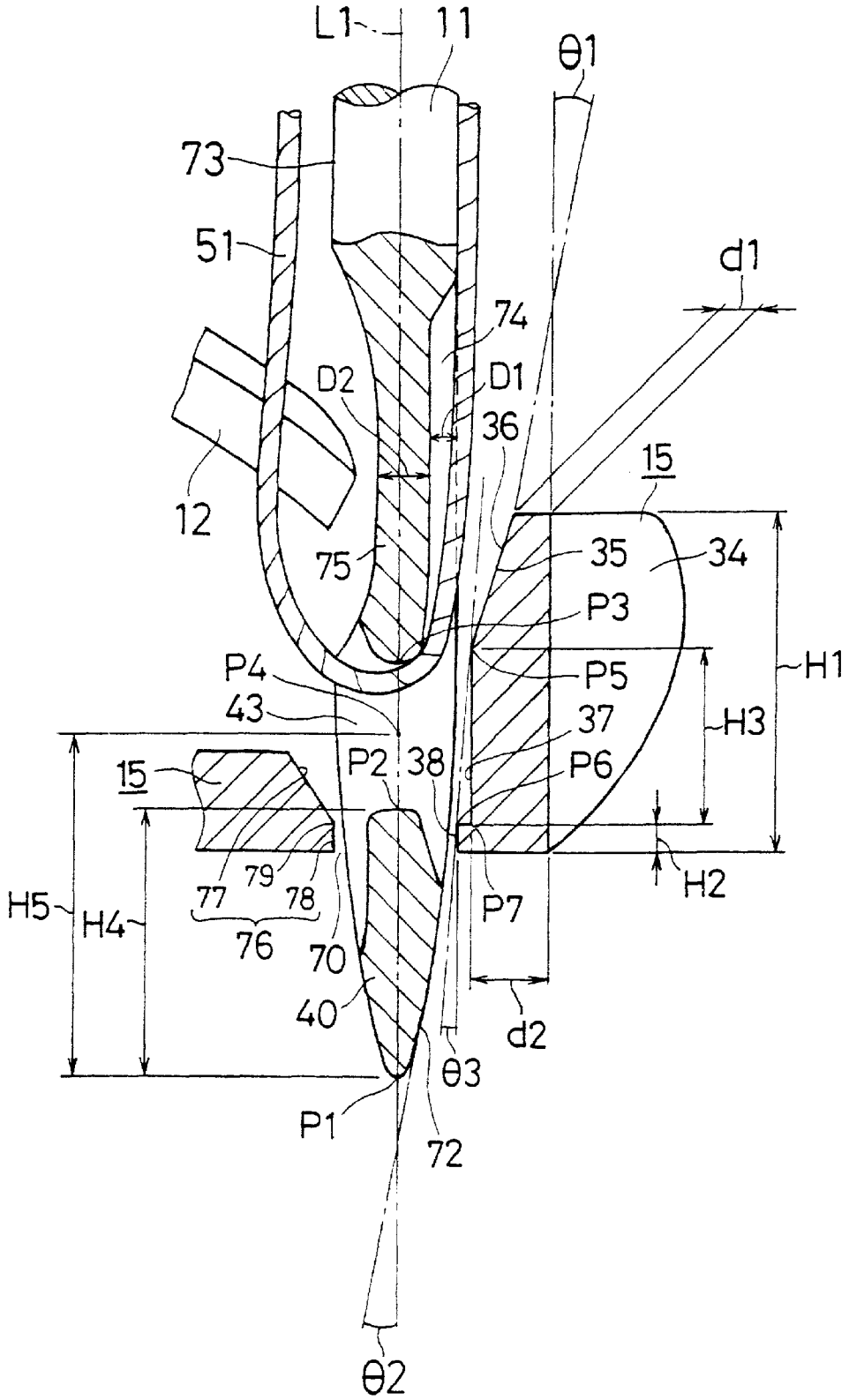
FIG. 3 is an expanded cross sectional view showing a needle location hole and a portion around the same of an inner loop taker of the vertically fully rotating hook which is shown in FIG. 2.
Figure 4:
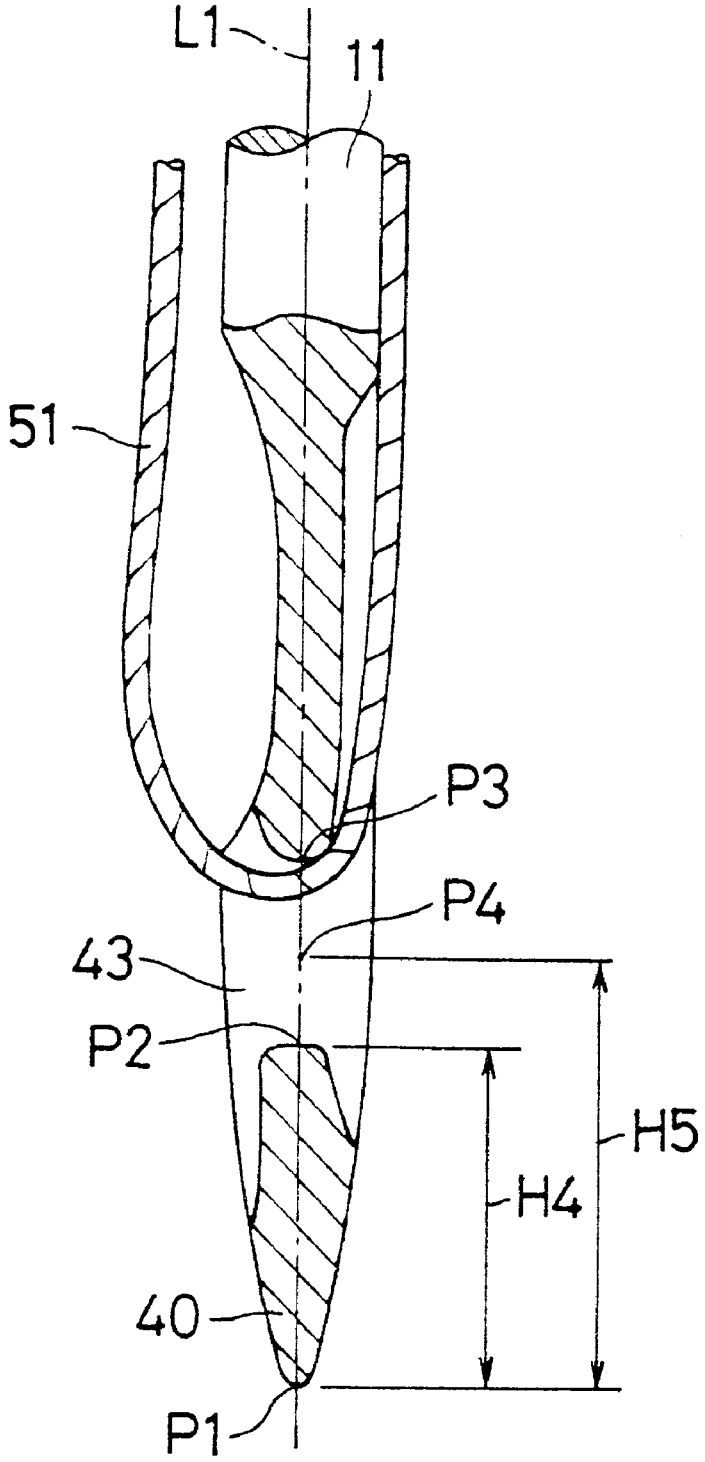
FIG. 4 is an expanded cross sectional view showing an eye which is shown in FIG. 3 and a portion around the same.
Figure 5:
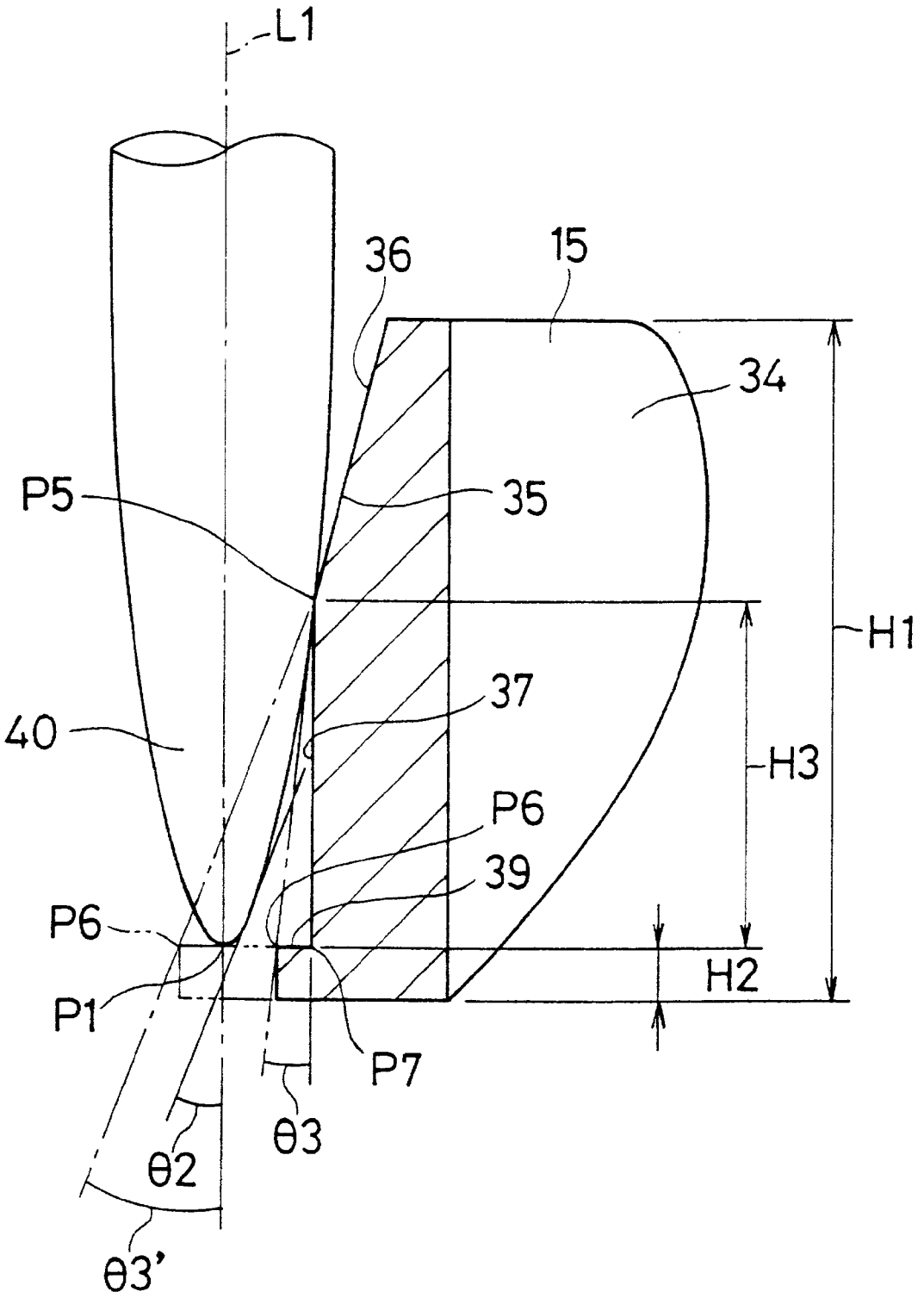
FIG. 5 is an expanded cross sectional view for illustrating a relationship between a wall of the vertically fully rotating hook and a needle.
Figure 6:
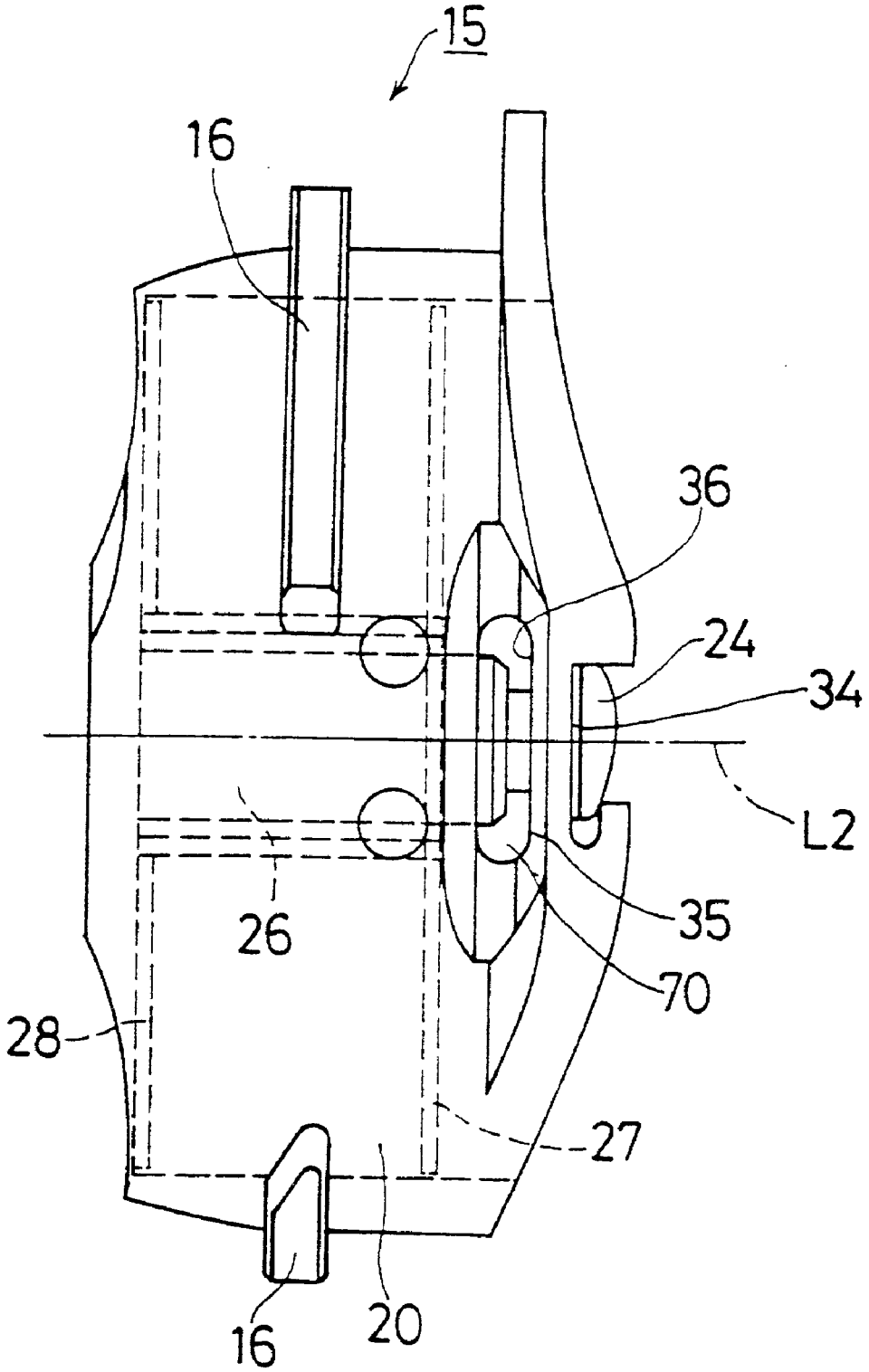
FIG. 6 is a plan view of the inner loop taker which is used in the vertically fully rotating hook which is shown in FIG. 2.
Figure 7:
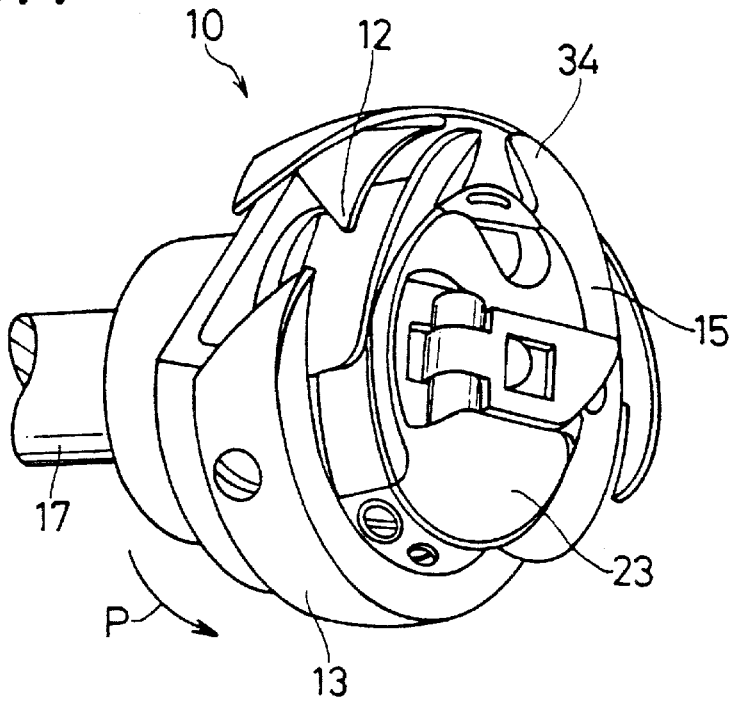
FIG. 7 is a perspective view of an outer loop taker which houses a bobbin, a bobbin case and the inner loop taker.

FIG. 2 is a cross sectional view of a vertically fully rotating hook 10 according to a preferred embodiment of the invention, FIG. 3 is an expanded cross sectional view showing a needle location hole 70 and a portion around the same of an inner loop taker 15 of the vertically fully rotating hook 10 which is shown in FIG. 2, FIG. 4 is an expanded cross sectional view showing an eye 43 which is shown in FIG. 3 and a portion around the same, FIG. 5 is an expanded cross sectional view showing a relationship between a wall 35 of the vertically fully rotating hook 10 and a needle 11, FIG. 6 is a plan view of the inner loop taker 15 which is used in the vertically fully rotating hook 10 which is shown in FIG. 2, and FIG. 7 is a perspective view of an outer loop taker 13 which houses a bobbin 22, a bobbin case 23 and the inner loop taker 15.

The vertically fully rotating hook 10 according to the preferred embodiment of the invention is a fully rotating hook in which an axial line L1 of the needle 11 is approximately vertical to a rotation axis L2 of the outer loop taker 13. The vertically fully rotating hook 10 comprises the outer loop taker 13 which is fixed to a drive shaft 17 by a screw 18 and the inner loop taker 15 which is housed in the outer loop taker 13. The inner loop taker 15 houses the bobbin case 23 which houses the bobbin 22 around which a bobbin thread 29 is wound. The outer loop taker 13, the inner loop taker 15, the bobbin 22 and the bobbin case 23 are made of stainless steel or steel.

The outer loop taker 13 is driven to rotate about the rotation axis L2 of the outer loop taker 13 in the direction which is indicated by an arrow P in FIG. 7, so that a needle thread 51 which is caught by a blade tip 12 is revolved along an outer peripheral surface 20 of the inner loop taker 15 and a stitch consequently is formed. A track projection 16 which is formed in the outer peripheral surface 20 of the inner loop taker 15 fits into a track groove 14 which is formed in an inner peripheral surface 19 of the outer loop taker 13, whereby the inner loop taker 15 is supported by the outer loop taker 13.

The inner loop taker 15 comprises a cylindrical portion 42 which is shaped like a cylinder and in which the track projection 16 is formed, a bottom portion 30 which extends continuously to one end portion of the cylindrical portion 41 in the axial direction, and an outward flange 34 which extends continuously to an open end of the cylindrical portion 41.

The bobbin case 23 which houses the bobbin 22 is mounted to a recess portion 21 of the inner loop taker 15. The bobbin 22 comprises a cylinder 26 which is formed as a right circular cylinder and which includes a central hole 25 in which a stud 24 is inserted, and a pair of flanges 27, 28 fixed to both end portions of the cylinder 26. The bobbin thread 29 is wound around the bobbin 22, and the stud 24 which is disposed upright to the bottom portion 30 of the inner loop taker 15 is inserted through the central hole 25.

The vertically fully rotating hook 10 as described above is disposed below a slide plate 31 of the sewing machine not shown. A needle hole 32 in which the needle 11 is inserted which moves up and down reciprocally is formed in the slide plate 31. A cloth 33 to be sewn is placed on the slide plate 31 and sewn.

The needle location hole 70 which is formed approximately as an oval shape and in which a tip portion 40 of the needle 11 is inserted is formed at the center of a top portion of a side wall of the inner loop taker 15, while the wall 35 is formed behind the outward flange 34 which faces the needle location hole 70, i.e., on the left-hand side in FIG. 2.

The needle 11 comprises a needle tip guiding surface 72, which is tapered and warped to have a gradually larger diameter upwardly as shown in FIG. 3, i.e., toward a needle bar (not shown) along the axial line L1 of the needle 11 from a needle tip P1, and an outer peripheral surface 73 which is formed into an approximately right circular cylindrical shape.

In the vicinity of the tip portion 40 of the needle 11, the eye 43 in which a needle thread 51 is inserted is formed. A recess groove 74 into which the needle thread 51 retracts extends continuously to the eye 43 and extends along the axial line L1 of the needle 11. A portion 75 in which the recess groove 74 is formed has a smaller diameter than an outer diameter of the needle 11 in the direction of the axial line L1 of the inner loop taker 15. As the needle thread 51 retracts into the recess groove 74, damage to the needle thread 51 is prevented while the needle thread 51 moves as it is held between the wall 35 and the needle 11.

The wall 35 includes a guiding surface 36, a first vertical surface 37 and a second vertical surface 38. The guiding surface 36 is formed to incline in a direction away from the axial line L1 of the needle 11 with a distance outwardly in a radial direction of the inner loop taker 15.

Further, an angle θ1 of the guiding surface 36 with respect to the axial line L1 of the needle 11 is larger than an inclination angle θ2 of the needle tip guiding surface 72 of the needle 11 with respect to the axial line L1 of the needle 11. The angle θ1 is selected in the range of 15 to 25 degrees, and preferably is 20 degrees. As to the angle θ1, values H1 and d2 (See FIG. 3) are restricted by mounting dimensions of the vertically fully rotating hook 10 to the sewing machine and the thickness of the needle 11, and values d1 and H2 (See FIG. 3) are determined by a positional relationship between prevention of collision between the outward flange 34 and the needle 11 and the eye 43, whereby the angle θ1 is determined.

The first vertical surface 37 extends continuously to an inward end P5 of the guiding surface 36 in the radial direction of the inner loop taker 15 and parallel to the axial line L1 of the needle 11. The second vertical surface 38 is formed inwardly of the first vertical surface 37 in the radial direction of the inner loop taker 15 but closer to the axial line of the needle 11 than the first vertical surface 37, and is parallel to the axial line L1 of the needle 11. As herein described, the first vertical surface 37 and the second vertical surface 38 are longitudinal surfaces extending from below to above. Further, the first vertical surface 37 and the second vertical surface 38 are formed vertically to the rotation axis L2 of the outer loop taker 13.

An angle θ3 of a straight line which links the inward end P5 and an outward end P6 of the second vertical surface 38 in the radial direction of the inner loop taker 15 with respect to the axial line L1 of the needle 11 is set smaller than the angle θ2 of the needle tip guiding surface 72 of the needle 11 with respect to the axial line L1 of the needle 11 ($\theta 3<\theta 2$), and a length H3 of the first vertical surface 37 is set to be equal to or smaller than a distance H4 along the axial line L1 of the needle 11 between a bottom end portion P2 of an inner peripheral surface of the eye 43 of the needle 11 and the needle tip P1 of the needle 11 ($H3 \leqq H4$).

Thus, since the guiding surface 36 is inclined in the direction away from the axial line L1 of the needle 11 with a distance outwardly in the radial direction of the inner loop taker 15, i.e., upwardly as shown in FIG. 3, the tip portion 40 of the needle 11 is guided into the needle location hole 70 by the guiding surface 36 so that the needle 11 is smoothly displaced downwardly. Further, since the guiding surface 36 is inclined in the direction away from the axial line L1 of the needle 11 with a distance outwardly in the radial direction of the inner loop taker 15 as described above, a gap between the needle 11 and the guiding surface 36 is progressively larger outwardly in the radial direction of the inner loop taker 15. Hence, the needle thread 51 does not slide between the needle 11 and the guiding surface 36, so that damage to the needle thread 51 is prevented. Moreover, since the gap between the needle 11 and the guiding surface 36 is progressively larger outwardly in the radial direction of the inner loop taker 15, it is possible that a depth D1 of the recess groove 74 into which the needle thread 51 retracts is small. This makes it possible to form the portion 75, in which the recess groove 74 is formed, of a large thickness D2, and hence, to improve the strength of the needle 11.

In addition, since the angle θ1 is larger than the angle θ2, even when the needle 11 which is displaced downwardly is subjected to force as the cloth 33 which is to be sewn is fed and the needle 11 is warped and contacts the guiding surface 36, the needle 11 is not subjected to large impact. That is, since the needle 11 is smoothly guided to the needle location hole 70 along the guiding surface 36, damage to the tip portion 40 of the needle 11 is prevented.

Further, the angle θ3 of the straight line which links the inward end P5 and the outward end P6 of the second vertical surface 38 in the radial direction of the inner loop taker 15 with respect to the axial line L1 of the needle 11 is set smaller than the angle θ2 of the needle tip guiding surface 72 of the needle 11 with respect to the axial line L1 of the needle 11 ($\theta 3<\theta 2$), and the length H3 of the first vertical surface 37 is set to be equal to or smaller than the distance H4 along the axial line L1 of the needle 11 between the bottom end portion P2 of the inner peripheral surface of the eye 43 of the needle 11 and the needle tip P1 of the needle 11 ($H3 \leqq H4$). Hence, even when the needle 11 which is displaced downwardly is subjected to force as the cloth 33 which is to be sewn is fed and the needle 11 is warped and displaced toward the wall 35, the needle tip P1 of the needle 11 does not collide with the outward end P6 of the second vertical surface 38 in the radial direction of the inner loop taker 15 nor a horizontal surface 39 which extends continuously from the outward end P6 to an inward end P7 of the first vertical surface 37 in the radial direction of the inner loop taker 15 and which is vertical to the axial line L1 of the needle 11. In short, since the needle 11 is smoothly guided to the needle location hole 70 along the wall 35, damage to the tip portion 40 of the needle 11 is prevented.

In a wall 76 which faces the needle location hole 70 of the cylindrical portion 41 of the inner loop taker 15, a first wall 77 and a second wall 78 are formed. The wall 76 is formed on the bottom portion 30 side of the inner loop taker 15, facing the guiding surface 36 and/or the first vertical surface 37 and/or the second vertical surface 38. The first wall 77 is formed to incline in a direction away from the axial line L1 of the needle 11 with a distance outwardly in the radial direction of the inner loop taker 15.

The second wall 78 extends continuously to an inward end 79 of the first wall 77 in the radial direction of the inner loop taker 15 and parallel to the axial line L1 of the needle 11.

A further detailed description will be given with reference to FIGS. 4 and 5. As described earlier, the needle 11 comprises the needle tip guiding surface 72, which is warped and tapered to have a gradually larger diameter with a distance toward the needle bar (not shown) along the axial line L1 of the needle 11 from the needle tip P1, and the outer peripheral surface 73 which is formed into a right circular cylindrical shape. In short, the configuration of the needle 11 shown in FIG. 4 from the needle tip P1 to the vicinity of the bottom end portion P2 of the inner peripheral surface of the eye 43 is a conical shape which is slightly swallowed. Further, the configuration of the needle 11 in the vicinity of an intersection between a plan surface which includes a central position P4 on the axial line of the needle between the bottom and top end portions P2 and P3 of the inner peripheral surface of the eye 43 of the needle 11 shown in FIG. 4, this plane surface being perpendicular to the axial line L1 of the needle 11, and the needle 11 is formed into a right circular cylindrical shape. Hence, as described earlier, when the configuration of the wall 35 does not satisfy the conditions $\theta 3<\theta 2$ and $H3 \leqq H4$, the needle tip P1 of the needle 11 collides with the outward end P6 or the horizontal surface 39 as indicated by an imaginary line in FIG. 5, and the needle 11 is accordingly damaged. On the other hand, when the wall 35 is formed to satisfy the conditions $\theta 3<\theta 2$ and $H3 \leqq H4$, the needle tip P1 of the needle 11 does not collide with the outward end P6 nor the horizontal surface 39 as indicated by a solid line in FIG. 5, so that the needle 11 is not damaged.

Another preferred embodiment of the invention is directed to a vertically fully rotating hook in which the angle $\theta 3$ of the straight line which links the inward end P5 and the outward end P6 of the second vertical surface 38 in the radial direction of the inner loop taker 15 with respect to the axial line L1 of the needle 11 is set smaller than the angle $\theta 2$ of the needle tip guiding surface 72 of the needle 11 with respect to the axial line L1 of the needle 11 ($\theta 3<\theta 2$), and the length H3 of the first vertical surface 37 is set to be equal to or smaller than a distance H5 along the axial line L1 of the needle 11 from the central position P4, which is on the axial line L1 of the needle 11 between the bottom and top end portions P2 and P3 of the inner peripheral surface of the eye 43 of the needle 11, to the needle tip P1 of the needle 11 ($H3 \leqq H5$). The vertically fully rotating hook according to this preferred embodiment of the invention has a structure similiar to the vertically fully rotating hook 10 described earlier, except for the fact that the condition $H3 \leqq H5$ is satisfied. As in the vertically fully rotating hook 10, even when the needle 11 which is displaced downwardly is subjected to force as the cloth 33 which is to be sewn is fed and the needle 11 is warped and displaced toward the wall 35, the needle tip P1 of the needle 11 does not collide with the outward end P6 of the second vertical surface 38 in the radial direction of the inner loop taker 15 nor the horizontal surface 39 which extends continuously from the outward end P6 to the inward end P7 of the first vertical surface 37 in the radial direction of the inner loop taker 15 and which is vertical to the axial line L1 of the needle 11. In short, since the needle 11 is smoothly guided to the needle location hole 70 along the wall 35, damage to the tip portion 40 of the needle 11 is prevented.

Figure 8:
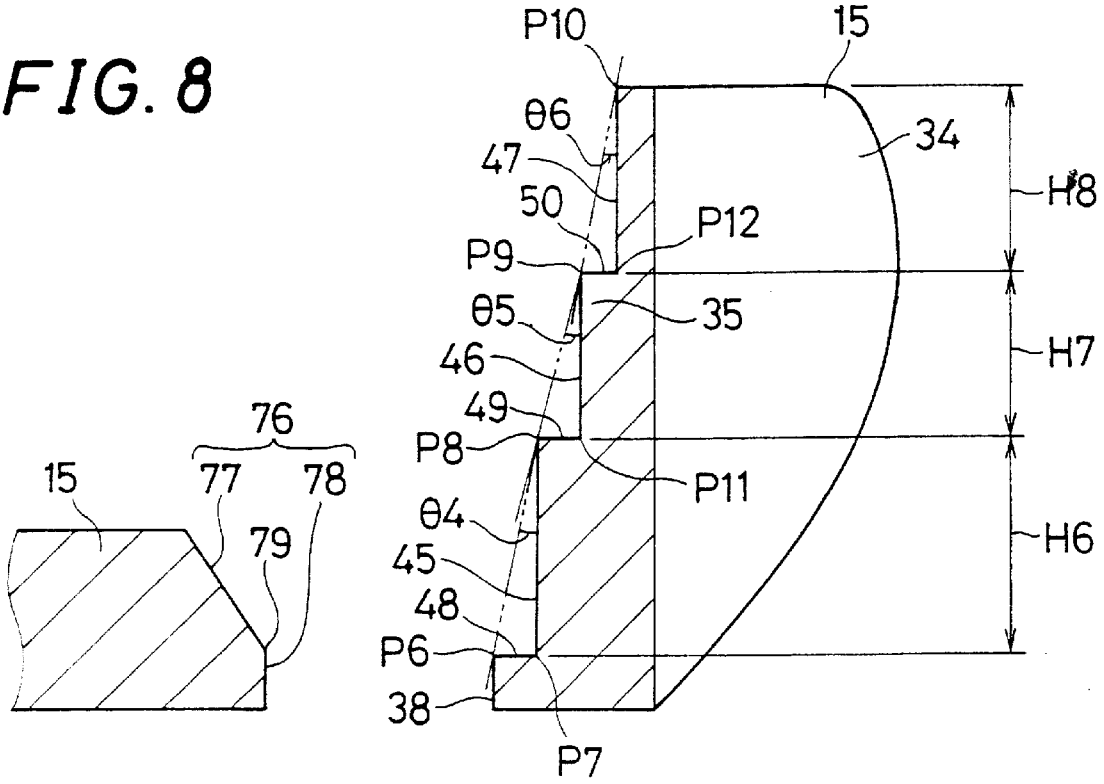
FIG. 8 is an expanded cross sectional view showing the wall of the vertically fully rotating hook according to another preferred embodiment of the invention.

FIG. 8 is an expanded cross sectional view showing the wall 35 of the vertically fully rotating hook 10 according to another preferred embodiment of the invention. In the outward flange 34 of the inner loop taker 15 is formed stepped wall 35 which includes a plurality of vertical surfaces 38, 45, 46, 47 which are parallel to the axial line L1 of the needle 11 and become closer to the axial line L1 of the needle 11 with a distance inwardly in the radial direction of the inner loop taker 15.

Angles $\theta 4$, $\theta 5$, $\theta 6$ of straight lines which connect the outward ends P6, P8, P9, P10 of the vertical surfaces 38, 45, 46, 47 of the wall 35 in the radial direction of the inner loop taker 15 with respect to the axial line L1 of the needle 11 are set smaller than the angle $\theta 2$ between the needle tip guiding surface 72 of the needle 11 and the axial line L1 of the needle 11 ($\theta 4<\theta 2$, $\theta 5<\theta 2$, $\theta 6<\theta 2$).

Lengths H6, H7, H8 of the vertical surfaces 45, 46, 47 are set to be equal to or smaller than the distance H4 along the axial line L1 of the needle 11 between the bottom end portion P2 of the inner peripheral surface of the eye 43 of the needle 11 and the needle tip P1 of the needle 11 ($H6 \leqq H4$, $H7 \leqq H4$, $H8 \leqq H4$).

As described above, the angles $\theta 4$, $\theta 5$, $\theta 6$ of straight lines which connect the outward ends P6, P8, P9, P10 of the vertical surfaces 38, 45, 46, 47 of the wall 35 in the radial direction of the inner loop taker 15 with respect to the axial line L1 of the needle 11 are set smaller than the angle $\theta 2$ between the needle tip guiding surface 72 of the needle 11 and the axial line L1 of the needle 11, and the lengths H6, H7, H8 of the vertical surfaces 45, 46, 47 are set to be equal to or smaller than the distance H4 along the axial line L1 of the needle 11 between the bottom end portion P2 of the inner peripheral surface of the eye 43 of the needle 11 and the needle tip P1 of the needle 11. That is, the vertical surfaces 38, 45, 46, 47 and the needle 11 have a similar relationship to that shown in FIG. 5 between the first vertical surface 37 and the needle 11. Hence, even when the needle 11 which is displaced downwardly is subjected to force as the cloth 33 which is to be sewn is fed and the needle 11 is warped and displaced toward the wall 35, the needle tip P1 of the needle 11 does not collide with the respective outward ends P6, P8, P9, P10 nor respective horizontal surfaces 48, 49, 50 which extend to the inward ends P7, P11, P12 of the vertical surfaces 45, 46, 47 in the radial direction of the inner loop taker 15 continuously from the respective outward ends P6, P8, P9, P10 and which are vertical to the axial line L1 of the needle 11. In short, since the needle 11 is smoothly guided to the needle location hole 70 along the wall 35, damage to the tip portion 40 of the needle 11 is prevented. Further, large warping of the needle 11 toward the open end of the inner loop taker 15 from the blade tip 12 is prevented, and therefore, the sewing performance is improved.

In a further preferred embodiment of the invention, the angles $\theta 4$, $\theta 5$, $\theta 6$ of respective straight lines which connect the outward ends P6, P8, P9, P10 of the vertical surfaces 38, 45, 46, 47 of the wall 35 in the radial direction of the inner loop taker 15 with respect to the axial line L1 of the needle 11 are set smaller than the angle θ2 between the needle tip guiding surface 72 of the needle 11 and the axial line L1 of the needle 11 (θ4<θ2, θ5<θ2, θ6<θ2), and the lengths H6, H7, H8 of the vertical surfaces 45, 46, 47 are set to be equal to or smaller than the distance H5 along the axial line L1 of the needle 11 from the central position P4, which is on the axial line L1 of the needle 11 between the bottom and top end portions P2 and P3 of the inner peripheral surface of the eye 43 of the needle 11, to the needle tip P1 of the needle 11 (H6≦H5, H7≦H5, H8≦H5).

Hence, even when the needle 11 which is displaced downwardly is subjected to force as the cloth 33 which is to be sewn is fed and the needle 11 is warped and displaced toward the wall 35, the needle tip P1 of the needle 11 does not collide with the respective outward ends P6, P8, P9, P10 nor the respective horizontal surfaces 48, 49, 50 which extend to the inward ends P7, P11, P12 of the vertical surfaces 45, 46, 47 in the radial direction of the inner loop taker 15 continuously from the respective outward ends P6, P8, P9, P10 and which are vertical to the axial line L1 of the needle 11. In short, since the needle 11 is smoothly guided to the needle location hole 70 along the wall 35, damage to the tip portion 40 of the needle 11 is prevented.

As a still further preferred embodiment of the invention, the invention is applicable to a vertically fully rotating hook in which the rotation axis of the inner loop taker 15 is inclined with respect to the rotation axis L2 of the outer loop taker 13.

As an even further preferred embodiment of the invention, the invention is applicable to a vertically fully rotating hook in which the axial line L1 of the needle 11 is inclined with respect to the rotation axis of the inner loop taker 15 and the rotation axis L2 of the outer loop taker 13.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A vertically fully rotating hook comprising:

a needle including an axis, a needle tip, a tip guiding surface tapering toward said tip, and an eye;

an inner loop taker having a needle location hole into which said needle is insertable, and an outward flange;

a stepped wall formed in said outward flange at a position facing said needle location hole;

said stepped wall including plural vertical surfaces extending parallel to said axis of said needle, said plural vertical surfaces being positioned progressively closer to said axis of said needle in a radial inward direction of said inner loop taker;

angles between straight lines linking radially outer ends of adjacent pairs of said vertical surfaces and said axis of said needle being smaller than an angle between said tip guiding surface and said axis of said needle; and a length of each said vertical surface in a direction parallel to said axis being equal to or smaller than a distance along said axis from a central position of said eye, which is on said axis and which is between top and bottom end portions of an inner peripheral surface defining said eye, to said needle tip.

2. A vertically fully rotating hook as claimed in claim 1, wherein said length of each said vertical surface is equal to or smaller than a distance along said axis between said bottom end portion of said inner peripheral surface and said needle tip.

3. A vertically fully rotating hook as claimed in claim 1, further comprising further surfaces extending from respective said radially outer ends in directions away from said axis.

4. A vertically fully rotating hook as claimed in claim 3, wherein said further surfaces extend transverse to said axis.

5. A vertically fully rotating hook as claimed in claim 1, comprising more than two said vertical surfaces.

6. A vertically fully rotating hook as claimed in claim 1, wherein all surfaces of said stepped wall extend either parallel to or transverse to said axis.

* * * * *